US006700568B2

(12) United States Patent
Nakamura

(10) Patent No.: US 6,700,568 B2
(45) Date of Patent: Mar. 2, 2004

(54) METHOD FOR DRIVING CAPACITIVE DISPLAY DEVICE

(75) Inventor: Eiji Nakamura, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 121 days.

(21) Appl. No.: 09/845,767

(22) Filed: May 2, 2001

(65) Prior Publication Data

US 2001/0054918 A1 Dec. 27, 2001

(30) Foreign Application Priority Data

May 2, 2000 (JP) ..... P2000-133719

(51) Int. Cl.[7] ..... G09G 5/00
(52) U.S. Cl. ..... 345/204
(58) Field of Search ..... 345/87, 89, 94, 345/95, 96, 76, 77, 79, 204, 208, 209, 210, 211, 212

(56) References Cited

U.S. PATENT DOCUMENTS

| | | | | |
|---|---|---|---|---|
| 4,488,150 A | * | 12/1984 | Kanatani | 345/77 |
| 4,594,589 A | * | 6/1986 | Ohba et al. | 345/210 |
| 5,606,342 A | | 2/1997 | Shoji et al. | |
| 5,929,847 A | | 7/1999 | Yanagi et al. | |
| 6,172,663 B1 | | 1/2001 | Okada et al. | |

FOREIGN PATENT DOCUMENTS

| | | |
|---|---|---|
| CA | 2022971 | 3/1991 |
| JP | 2-120724 | 5/1990 |
| JP | 5-46128 | 2/1993 |
| JP | 6-35416 A | 2/1994 |
| JP | 7-134573 A | 5/1995 |
| JP | 7-181924 A | 7/1995 |
| JP | 8-251518 A | 9/1996 |
| JP | 9-120053 | 5/1997 |
| JP | 2830004 | 9/1998 |
| JP | 2000-29547 | 1/2000 |

OTHER PUBLICATIONS

Japanese Office Action dated Jul. 22, 2003.

* cited by examiner

*Primary Examiner*—Steven Saras
*Assistant Examiner*—Paul A. Bell
(74) *Attorney, Agent, or Firm*—Nixon & Vanderhye P.C.

(57) ABSTRACT

When charging at a voltage with a polarity different from that of a voltage charged in the capacitive display element, by turning the switch ON, after carrying out a charging/discharging to modulate the both electrodes of the capacitive display element to the ground potential, the same is charged at a voltage with another polarity. As compared with the case where the charging/discharging between the positive power supply voltage $+V_M$ and the negative power supply voltage $-V_M$ is made directly, the electric power consumption can be reduced to ½ when the same is once modulated to the ground potential 0V. The electric power consumption can be further reduced by modulating the intermediate potential in a plurality of steps.

9 Claims, 5 Drawing Sheets

FIG.7 Rrior Art
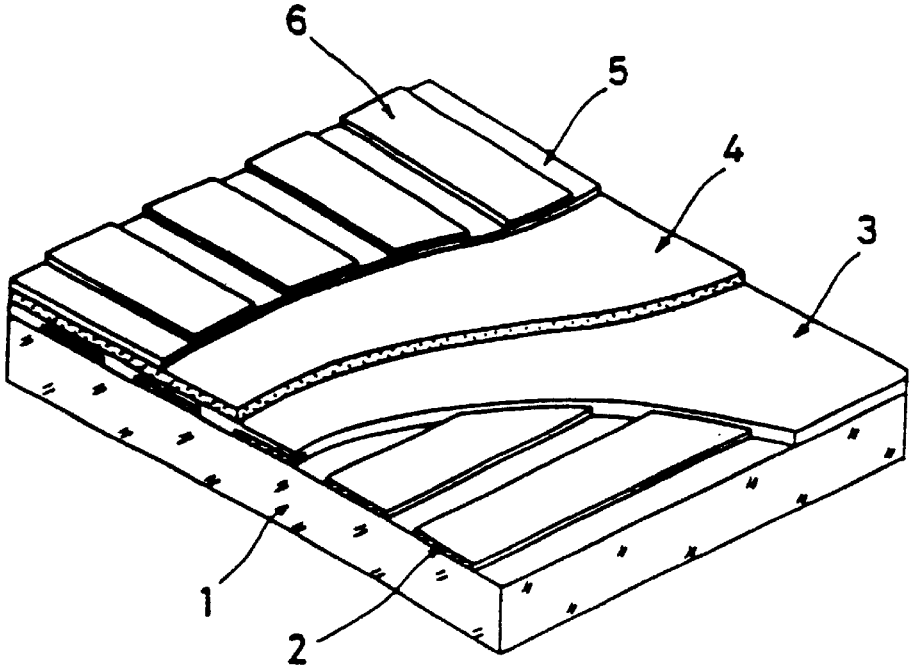
FIG.8 Rrior Art
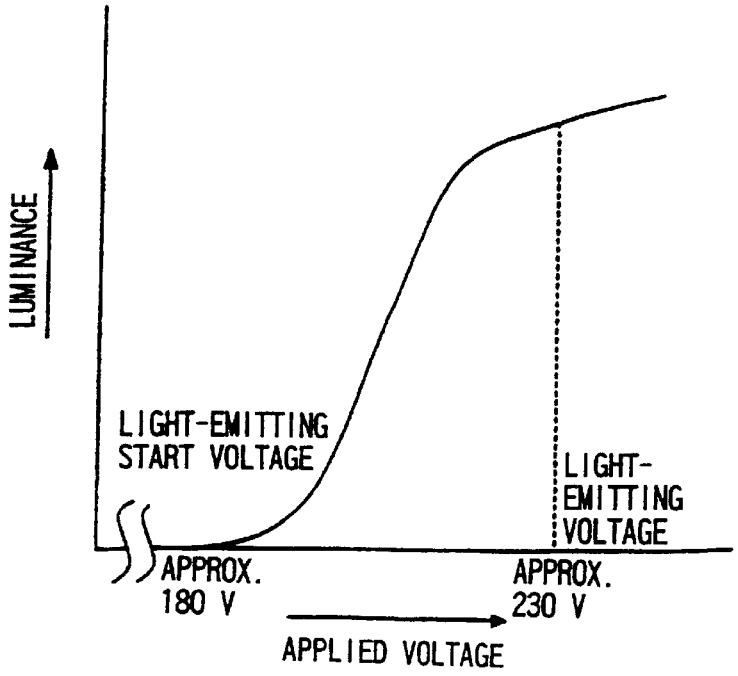

METHOD FOR DRIVING CAPACITIVE DISPLAY DEVICE

BACKGROUND OF INVENTION

1. Field of the Invention

The present invention relates to a method for driving capacitive display device such as an inorganic EL display device and a simple matrix type liquid crystal display device or the like.

2. Description of the Related Art

Recently, a variety of plane display devices have been developed. In various kinds of the plane display devices, even when the materials for display elements and the voltage values applied to display panels are different from each other, the structures of the periphery voltage applying circuits and the periphery control circuits are similar to each other. Therefore, hereinafter, although a description will be made while taking an inorganic EL display device as an example in which a phenomenon of electroluminescence (hereinafter, referred to as "EL" for short) is utilized, it is noted that the invention is not limited thereto.

FIG. 7 illustrates a basic structure of an inorganic EL display panel. In the inorganic EL display panel, disposed parallelly on an electrical insulating substrate such as a glass substrate 1 is a ribbon-like first electrode group 2, laminated thereon is a dielectric material 3, further laminated thereon is an EL layer 4, still further laminated thereon is a dielectric material 5 so as to form a three-layered structure. On the three-layered structure, disposed parallelly is a ribbon-like second electrode group 6 that extends in the direction crossing at right angles to the first electrode group 2 so as to form inorganic EL elements at the crossing portions between the first electrode group 2 and the second electrode group 6. The inorganic EL elements are formed in a space where the ribbon-like electrodes of the first electrode group 2 face the ribbon-like electrodes of the second electrode group 6, and between the electrodes at both sides are interposed a three-layered dielectric material layer comprised of dielectric material 3, 5 and an EL layer 4. Accordingly, the inorganic EL elements are capacitive and are possible to be handled as capacitors in an electrical aspect. In a simple matrix type liquid crystal display panel also, since between the electrodes are interposed an electrical insulating liquid crystal layer, the same as the inorganic EL element, the liquid crystal display element is possible to be handled as a capacitor.

FIG. 8 shows an example of relationship between an impressed voltage applied to an inorganic EL element and a light-emitting luminance thereof. The inorganic EL element emits light when a voltage is applied of which absolute value is larger than a light emitting start voltage of approximately 180V. The light-emitting voltage at which a sufficient luminance is obtained is approximately 230V. Further, in the inorganic EL element, since the characteristic thereof may be changed when a voltage of an identical polarity is applied for a long period of time, it is necessary to carry out an alternating current drive in which positive voltage and negative voltage are applied alternately. Consequently, for an inorganic EL element having a character as shown in FIG. 8, it is necessary to drive the same by means of a relatively high voltage of approximately ±200V.

In an inorganic EL display panel having a basic structure as shown in FIG. 7, one of the first electrode group 2 and the second electrode group 6 of the inorganic EL elements is determined as a data-side electrode; the another is determined as a scan-side electrode. The inorganic EL elements formed at the crossing portions between the data-side electrodes and the scan-side electrodes constitute pixels respectively. Accordingly, in an inorganic EL display panel as shown in FIG. 7, the pixels are arrayed in a matrix configuration.

Conventionally, in a display device in which inorganic EL elements having a basic structure as shown in FIG. 7 are used, a scan-side drive IC is provided as a drive circuit of the scan-side electrodes; a data-side drive IC is provided as a drive circuit of the data-side electrodes. The scan-side drive IC includes a switching element for applying negative voltage to the data-side electrodes and a switching element for applying positive voltage thereto. The data-side drive IC is comprised of a structure in which a switching element for charging the EL layer 4 with modulating voltage, a switching element for discharging the same and diodes disposed in an inverse direction of the current of the respective switching elements are connected with each other. At the data-side, in accordance with display data, a modulating drive is made using the charging or discharging switching element while at the scan-side, the field that provides positive voltage and the field that provides negative voltage are repeated alternately to carry out, what is called, a field inverting drive in order to apply well-symmetric alternating pulses to the EL layer 4 providing a highly reliable display.

Furthermore, in a modulating system drive circuit for carrying out modulating drive in accordance with the display data, it is possible to use a driving element comprised of a double-well structured IC that has been recently developed. The modulating voltage applied from the data-side in accordance with the display data is modulated into a positive or negative voltage whereby a driving method is made possible in which the voltage that has the same absolute value is applied in both cases where a negative voltage or a positive voltage is applied to the data-side electrode as the driving voltage of the scan-side electrode. By virtue of a bipolar drive as described above, it is made possible to apply a better-symmetric alternating pulse voltage to the inorganic EL element.

FIG. 9 shows an equivalent circuit as a conventional modulating system drive circuit in which an inorganic EL element as shown in FIG. 7 is handled as just a capacitor having a capacity C as a capacitive display element 10. The capacitive display element 10 is driven by being charged/discharged at a voltage of $+V_M$ from a positive power supply 11 or at a voltage of $-V_M$ from a negative power supply 12. Current i that flows while charging/discharging the capacitive display element 10 from the positive power supply 11 or the negative power supply 12 flows also through a resistance 13 residing in the wirings or the like. The modulating system drive circuit may be represented as switches 21, 22 that switch the positive power supply 11 or the negative power supply 12 to apply a voltage to the capacitive display element 10.

FIG. 10 shows a driving voltage waveform in the equivalent circuit in FIG. 9. Now, assuming that a switch 21 represented with $SW_P$ is ON; a switch 22 represented with $SW_N$ is OFF, and the capacitive display element 10 is charged at a voltage $V_M$. At this time, it is understandable that the potential level at the positive electrode of the capacitive display element 10 is $+\frac{1}{2} V_M$, and the potential level at the negative electrode is $-\frac{1}{2} V_M$. Now, a consideration will be given about a case where, from a state in which the capacitive display element 10 is charged with the switch 21 closed and the switch 22 opened, the same is charged at a voltage $V_M$ in inverted polarity by switching the switch 21

$SW_P$ to OFF; the switch 22 $SW_N$ to ON. The polarity of both electrodes of the capacitive display element 10 is inverted respectively, and electric power is consumed at a resistance 13 by the current i that flows at this time accompanying with the shift of the electric charge.

First, in case where a capacity C charged at a voltage $\alpha V_M$ is charged at a voltage $\beta V_M$, the electric energy consumed at a resistance R is calculated by Expression 1 as below. Herein, $\alpha$ and $\beta$ are random values, respectively within $-1 \leqq \alpha \leqq 1$, $-1 \leqq \beta \leqq 1$. At this time, the following Expression 1 is obtained.

$$Ri + \frac{1}{C}\int i dt = \beta V_M \tag{1}$$

When current i in Expression 1 is substituted with electric charge q, the following Expression 2 is obtained.

$$R\frac{dq}{dt} + \frac{1}{C}q = \beta V_M \tag{2}$$

General solution of a constant coefficient linear differential equation as shown in Expression 2 may be expressed as the following Expression 3 as an initial condition in which A is determined by a constant of integration.

$$q = C\beta V_M + Ae^{-\frac{t}{CR}} \tag{3}$$

In the initial condition at t=0, being charged at a voltage $\alpha V_M$, the following Expression 4 and Expression 5 are obtained from the Expression 3.

$$C\alpha V_M = C\beta V_M + Ae^{-\frac{0}{CR}} \tag{4}$$

$$\therefore A = C(\alpha - \beta)V_M \tag{5}$$

By substituting Expression 5 for Expression 3, the following Expression 6 is obtained.

$$q = C\beta V_M + C(\alpha - \beta)V_M e^{-\frac{t}{CR}} \tag{6}$$

By differentiating Expression 6 with time t to calculate current i, the following Expression 7 is obtained.

$$i = \frac{dq}{dt} = C(\alpha - \beta)V_M e^{-\frac{t}{CR}} \times \left(-\frac{1}{CR}\right) = \frac{(\beta - \alpha)V_M}{R} e^{-\frac{t}{CR}} \tag{7}$$

Assuming that electric power consumed at the resistance 13 with a resistance value R is $W_R$, the following Example 8 is obtained.

$$W_R = \int_0^t I^2 R dt \tag{8}$$

By substituting Expression 7 for Expression 8, the following Expression 9 is obtained.

$$\begin{aligned} W_R &= \int_0^t \left(\frac{(\beta - \alpha)V_M}{R} e^{-\frac{t}{CR}}\right)^2 R dt = \frac{\{(\beta - \alpha)V_M\}^2}{R}\int_0^t e^{-\frac{2t}{CR}} dt \\ &= \frac{\{(\beta - \alpha)V_M\}^2}{R} \times \left(-\frac{CR}{2}\right) \times \left[e^{-\frac{2t}{CR}}\right]_0^t \\ &= \frac{1}{2}C\{(\beta - \alpha)V_M\}^2\left(1 - e^{-\frac{2t}{CR}}\right) \end{aligned} \tag{9}$$

now, considering a limit of $t \to \infty$, the following Expressing 10 is obtained.

$$W_R = \frac{1}{2}C\{(\beta - \alpha)V_M\}^2 \tag{10}$$

Therefore, in case of charging at a voltage $-V_M$ in inverted polarity from a state being charged at a voltage $V_M$, since $\alpha=1$, $\beta=-1$, by substituting them for Expression 10, the electric power consumption $W_1$ by the resistance 13 of resistance value R, is expressed as the following Expression 11.

$$W_1 = \frac{1}{2}C\{(-1 - 1)V_M\}^2 = 2CV_M^2 \tag{11}$$

As for a technique for reducing loss electric power $W_1$ like this, for example, Japanese Unexamined Patent Publication JP-A 6-35416 (1994) discloses a method for driving active matrix type liquid crystal display device, in which a voltage selected out of a plurality of voltage levels excluding the maximum voltage corresponding to the tone displays is applied with a voltage having an inverted polarity after the tone level is decreased once.

In an inorganic EL display panel having a basic structure as shown in FIG. 7, the electrode groups at the scan electrode side are simply selected and driven one by one. Whereas, as for the electrode groups at the data electrode side, it is necessary to drive every electrode groups every scanning operation. That is to say, in the modulating system drive circuit at the data electrode side, since the entire EL display panel is charged every scanning operation, the electrical power consumption becomes large as well as the ratio in the electrical power consumption of the entire display apparatus becomes large. Accordingly, in order to reduce the electrical consumption effectively, it is necessary to reduce loss electric power expressed in Expression 11 due to the resistance in the drive circuit.

As the driving method disclosed in the aforementioned JP-A 6-35416, a technique, in which a lower voltage level is selected out of a plurality of voltage levels provided according to the respective tone displays, and after converting the voltage level the voltage with an inverse polarity is applied thereto, is not applicable to a case where the drive circuit does not have a plurality of voltage levels, for example, a drive that does not carry out tone display or does not perform intermediate tone display; or, a drive in which intermediate tone display is performed by carrying out pulse width control of the voltage corresponding to the tone level, or the like. Also, since the electric charge charged in the capacitive display element 10 is entirely consumed by the resistance 13, the electric power consumption becomes large as well as a problem of a heat generation is also resulted in.

SUMMARY OF THE INVENTION

An object of the invention is to provide a method for driving a capacitive display apparatus, capable of reducing electric power consumption caused by electric current that flows to charge/discharge the capacitive display element during driving the same alternately by means of a voltage with positive and negative polarities.

The invention provides a method for driving a capacitive display apparatus having a plurality of display pixels comprised of capacitive elements which are disposed respectively at crossing portions between data-side electrodes and scan-side electrodes, the method comprising the steps of:

driving the data-side electrodes at a voltage corresponding to display data, while scanning the scan-side electrodes to be selected sequentially;

applying a driving voltage to the display pixels to carry out a display operation; and when the data-side electrodes are driven to be charged with a voltage having an inverse polarity relative to a voltage charged at a previous charge, charging/discharging the data-side electrodes once to an intermediate potential level of which absolute value is smaller than the voltage applied for display operation between the charging voltages before and after driving the same.

According to the invention, in the capacitive display apparatus that includes a plurality of display pixels comprised of capacitive elements respectively disposed at the crossing portions between the data-side electrodes and the scan-side electrodes, display operation can be carried out by driving the data-side electrodes at a voltage corresponding to display data and applying a driving voltage to the display pixels while scanning sequentially scan-side electrodes to be selected. When driving the data-side electrode to charge the same at a voltage with an inverse polarity relative to the voltage charged at the previous charge, since the same is charge/discharged to an intermediate potential level of which absolute value is smaller than the voltage applied to display between the charging voltages before and after driving the same, it is made possible to reduce electric power consumption as compared with a directly charging/discharging between the charging voltages before and after driving the same. Because the electric power consumption is proportional to the square of the voltage, it becomes smaller when being modulated once to an intermediate potential level. Since the data-side electrodes are necessary to be driven every scanning operation, it is made possible that a reduction of electric power consumption for driving the data-side electrodes contributes largely to reduce electric power consumption for driving the entire capacitive display apparatus.

According to the invention, in the process of charging/discharging the capacitive display element, since an intermediate potential level is provided, after carrying out charging/discharging once using the potential as a power supply, and then a charging/discharging to the objective potential level from the present potential level is carried out, it is made possible to reduce electric power consumption largely. Particularly, as for the data-side electrodes, it is necessary to drive every electrode every time of scanning. Accordingly, since the frequency to charge/discharge the capacitive display element with a polarity different from each other before and after driving the same, it is made possible to make it contribute to reduce electric power consumption with a large ratio.

Further, in the invention it is preferable that when the scan-side electrodes are driven so as to be charged at a voltage with an inverse polarity relative to the voltage charged at the previous charge, the scan-side electrodes are charged/discharged once to an intermediate potential level between the charging voltages before and after driving the scan-side electrodes.

According to the invention, also when driving the scan-side electrodes at a voltage with an inverse polarity relative to the voltage charged at the previous charge, since the scan-side electrodes are charged/discharged once to an intermediate potential level between charging voltages before and after driving the same, it is made possible to reduce larger electric power consumption as compared with a direct charging/discharging between the charging voltages before and after driving the same.

Furthermore, according to the invention, when driving the scan-side electrode, since the potential is once charged/discharged to an intermediate potential level, it is made possible to reduce electrical power consumption.

Still further, in the invention it is preferable that the intermediate potential is the ground potential.

According to the invention, when charging/discharging the data-side electrodes or scan-side electrodes, as charging/discharging the same to the ground potential as the intermediate potential, in the case where charging/discharging is made between the voltages having the same absolute value but a polarity different from each other, by charging/discharging once the same to the ground potential, it is made possible to reduce electrical power consumption to a half.

Still further, according to the invention, since the ground potential is used as an intermediate potential, it is not necessary to provide additional power supply. Accordingly, it is made possible to build the structure at a low cost as well as to carry out charging/discharging so that electrical power consumption results in ½ as compared with the case where direct charging/discharging is carried out.

Still further, in the invention it is preferable that the charging/discharging to a intermediate potential is carried out in such manner that the power supply potential to be charged/discharged is gradually modulated in three or more steps within a range of the charging voltages before and after driving the scan-side electrodes.

According to the present invention, when charging/discharging, since the power supply potential is gradually charged/discharged in three or more steps, it is made possible to further reduce electrical power consumption.

Still further, according to the invention, since the charging/discharging to an intermediate potential is made while modulating the voltage gradually in three or more steps within the range between the voltages before and after charging/discharging the scan-side electrodes, it is made possible to further reduce electrical power consumption.

Still further, in the invention it is preferable that the charging/discharging to an intermediate potential is carried out using a capacitor of random potential between the charging/discharging voltages before and after the driving the scan-side electrodes.

According to the invention, when charging/discharging the voltage charged in the capacitive display element to a voltage with an inverse polarity, since the charging/discharging to the intermediate potential is carried out using a capacitor of random potential between the voltages before and after charging/discharging the scan-side electrodes, the voltage between the capacitive display element and the capacitor varies due to the charging/discharging to the capacitor. Accordingly, it is made possible to further reduce the electric power consumption.

Still further, according to the invention, when the charging/discharging is made, since a capacitor of random potential is used as a power supply for once charging/discharging to the intermediate potential, it is made possible to further reduce the electric power consumed when charging/discharging to the intermediate potential.

Still further, in the invention it is preferable that an electric charge collected to the capacitor of random potential is reused.

According to the invention, since the electric charge collected to the capacitor of random potential during charging/discharging the capacitive display element is reused, it is made possible to utilize effectively the electric power which is consumed as a loss electric power.

Still further, according to the invention, since the electric charge collected to the capacitor of random potential is reused, the electric power which, in the case where the capacitor is not used, should be consumed, is used effectively. Accordingly, it is made possible to reduce the entire electric power consumption.

Still further, in the invention it is preferable that the process of charging/discharging to the intermediate potential is carried out in such way that the charging/discharging to the capacitive display element is made, not by charging/discharging an electrical charge directly to the capacitive display element, but by charging/discharging an electrical potential of one electrode of the capacitor to change an electrical potential of another electrode.

According to the invention, it is made possible to charge/discharge the capacitive display element while collecting the electric charge to the capacitor, and to reuse the electric charge collected to the capacitor for driving the capacitive display element.

Still further, according to the invention, by connecting the capacitive display element with the capacitor in series, it is made possible to reduce electric power consumption as well as to reuse the electric charge charged in the capacitor.

Still further, in the invention it is preferable that the capacitive display element is an inorganic EL element.

According to the invention, it is made possible to reduce electric power consumption used for driving the inorganic EL element which handles a voltage of relatively high absolute value.

Still further, according to the invention, it is made possible to reduce electric power consumption in the case where the inorganic EL element is driven.

Still further, in the invention it is preferable that the capacitive display element is a liquid crystal display element.

According to the invention, it is made possible to reduce electric power consumption necessary for driving the liquid crystal display element.

Still further, according to the invention, it is made possible to reduce electric power consumption in case where the liquid crystal element is driven.

BRIEF DESCRIPTION OF THE DRAWINGS

Other and further objects, features, and advantages of the invention will be more explicit from the following detailed description taken with reference to the drawings wherein:

FIG. 7 is an illustration showing a fundamental structure of an inorganic EL display panel;

FIG. 8 is a graph showing an example of a relationship between impressed voltage to the inorganic EL display panel and luminance thereof;

DETAILED DESCRIPTION OF THE PREFERRED EMBODIMENTS

Figure 1:
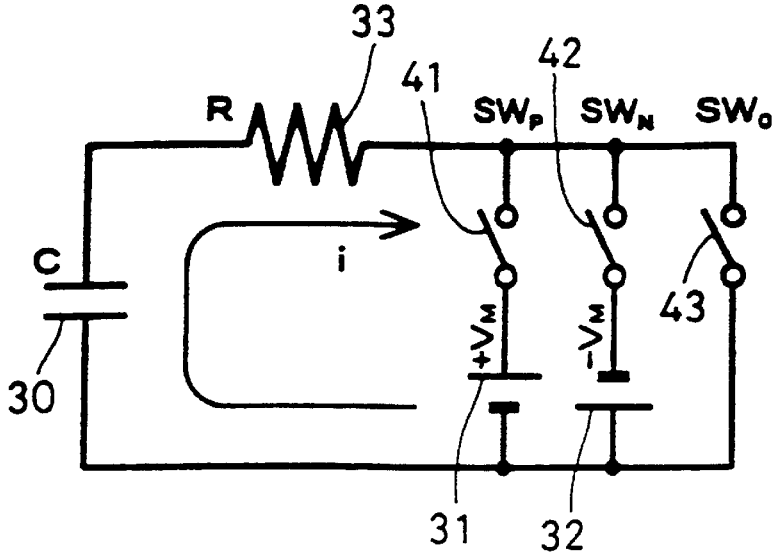
FIG. 1 is an equivalent circuit diagram that carries out a method of driving according to an embodiment of the present invention.

Now referring to the drawings, preferred embodiments of the invention are described below.

FIG. 1 shows equivalently a drive circuit for carrying out the driving method according to an embodiment of the invention. A capacitive display element 30, a positive power supply 31, a negative power supply 32, a resistance 33, and switches 41, 42 are substantially equivalent to the capacitive display element 10, the positive power supply 11, the negative power supply 12, the resistance 13 and switches 21, 22. According to the embodiment of the invention, a switch 43 represented with $SW_O$ is added so that the capacitive display element 30 is short-circuited between both electrodes thereof. When the capacitive display element 30 is being charged at a voltage $V_M$, it is understandable that the potential level of one electrode is $+\frac{1}{2} V_M$ and that of another electrode is $-\frac{1}{2} V_M$. At this time, it is understandable that it is equivalent to a fact the switch 43 modulates the potential between the both electrodes of the capacitive display element 30 to ground potential level.

Figure 2:
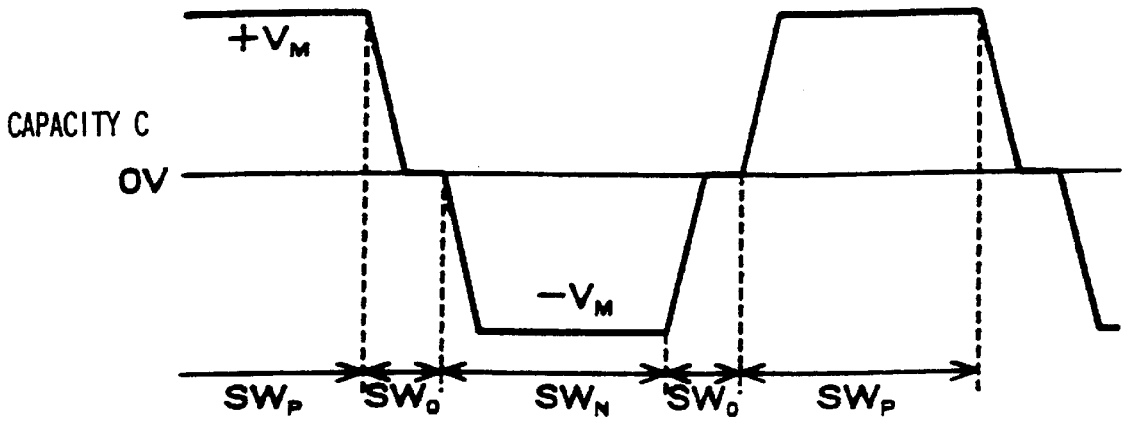
FIG. 2 is a time chart illustrating a drive waveform of a capacitive display element 30 that is driven by means of the embodiment shown in FIG. 1.

A consideration will be given about electric power consumed by the resistance 33 of a resistance value R in an equivalent circuit shown in FIG. 1 when the capacitive display element 30 is driven by a drive voltage waveform as shown in FIG. 2. When the capacity C of the capacitive display element 30 is charged at a voltage $V_M$ while the switch 41 $SW_P$ is ON; the switch 42 $SW_N$ is OFF and the switch 43 $SW_O$ is OFF, the electrode potential of the capacitive display element 30 is $\pm\frac{1}{2} V_M$. From this state, when the polarity of the potential on both electrodes is inverted respectively by modulating the electric charge to 0 once in a way of switching the switch 41 $SW_P$ to OFF, the switch 42 $SW_N$ to OFF and the switch 43 $SW_O$ to ON; and then, switching the switch 41 $SW_P$ to OFF, the switch 42 $SW_N$ to ON and the switch 43 $SW_O$ to OFF to charge the same at a voltage $V_M$ in inverse direction. First, assuming that the charged voltage of C is $+V_M \rightarrow 0$, electric energy $W_{2a}$ consumed at the resistance 33 of resistance value R is obtained as Expression 12 from Expression 10, wherein, $\alpha=1$, $\beta=0$.

$$W_{2a} = \frac{1}{2}C\{(0-1)V_M\}^2 = \frac{1}{2}CV_M^2 \tag{12}$$

Next, a consideration will be given about the limit of C at charging voltage $0V \rightarrow -V_M$. In this case, since $\alpha=0$, $\beta=-1$ in Expression 10, the following Expression 13 is obtained.

$$W_{2b} = \frac{1}{2}C\{(-1-0)V_M\}^2 = \frac{1}{2}CV_M^2 \tag{13}$$

Therefore, in case where the potential is once modulated to the ground potential GND (0V) and then charging/discharging is made, the electric power consumption $W_2$ is obtained as expressed in Expression 14 from Expression 12 and Expression 13. In comparison between the electrical power consumption $W_2$ and the electrical power consumption $W_1$ in which charging is made directly as expressed in Expression 11, the electrical power consumption $W_2$ is decreased to ½ of the electrical power consumption $W_1$. That is, since the electrical power consumption is proportional to the square of the voltage, even when charging/discharging is made twice at a voltage reduced to ½, it is made possible to reduce the electrical power consumption to ½ of the same in case where the charge/discharging is made directly.

$$W_2 = W_{2a} + W_{2b} = \frac{1}{2}CV_M^2 + \frac{1}{2}CV_M^2 = CV_M^2 \tag{14}$$

Herein, in a general way, assuming that $\chi V_M$ is the power supply voltage to which intermediately charged/discharged, and after a charging/discharging $\alpha V_M \rightarrow \chi V_M$ is made, a charging/discharging $\chi V_M \rightarrow \beta V_M$ is made using $\beta V_M$ as the power supply; and defining that the electrical power consumption is $W_{3a}$, $W_{3b}$ respectively; the electrical power consumption $W_3$ is obtained from Expression 10 as the following Expression 15.

$$\begin{aligned} W_3 &= W_{3a} + W_{3b} \\ &= \frac{1}{2}C\{(\chi-\alpha)V_M\}^2 + \frac{1}{2}C\{(\beta-\chi)V_M\}^2 \\ &= \frac{1}{2}CV_M^2\{2\chi^2 + (2\alpha+\beta)\chi + \alpha^2 + \beta^2\} \\ &= CV_M^2\left\{\left(\chi - \frac{\alpha+\beta}{2}\right)^2 + \left(\frac{\alpha-\beta}{2}\right)^2\right\} \end{aligned} \tag{15}$$

From Expression 15, when $\chi=(\alpha+\beta)/2$, the electrical power consumption results in the minimum value expressed with the Expression 16.

$$W_3(\text{Min}) = \frac{1}{4}C\{(\alpha-\beta)V_M\}^2 \tag{16}$$

In FIG. 1, since $\alpha=1$, $\beta=-1$, and $\chi=(\alpha+\beta)/2=(-1+1)/2=0$. Accordingly, the electric power consumption expressed with Expression 14 results in the minimum value. That is, when charging/discharging is made between the voltages having the same absolute value and different polarity from each other, the electrical power consumption of a case where the potential is once modulated to the ground potential (GND) of 0V and then charging/discharging is made becomes the minimum value.

Further, even when the intermediate potential $\chi V_M = V_S$ is not at the ground potential (GND), in case where $-V_M < V_S < +V_M$, an reduction effect of the electric power consumption is obtained. For example, assuming that $V_M$=40V, the electrical power consumption $W_4$ in a case of direct charging is expressed as Expression 17 from Expression 11.

$$W_4 = 2C \times 40^2 = 3200C(W) \tag{17}$$

Figure 3:
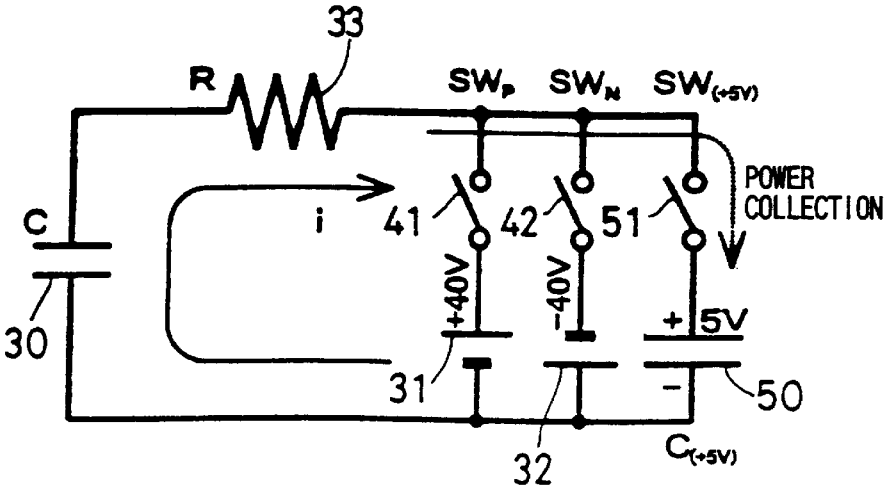
FIG. 3 is an equivalent circuit diagram relative to a driving method for another embodiment of the invention.

According to another embodiment of the invention, FIG. 3 shows an equivalent circuit of a case where a capacitor 50 is provided as a power supply to be charge/discharged. In the equivalent circuit in FIG. 3, parts corresponding to the parts in the equivalent circuit in FIG. 1 are given identical reference numerals or characters and duplicated descriptions will be omitted. The capacitor 50 is connected with a switch 51 in series. In case where the capacitor 50 has a considerably larger capacity as compared with the capacity C of the capacitive display element 30, the same is usable as an intermediate potential of ±40V, for example, a power supply for 5V. A consideration will be given on a case where, after a charging/discharging +40V→+5V is made, using the −40V as a power supply to be charged/discharged, a charged/discharged +5V→−40V is made. Assuming the electrical power consumption as $W_{5a}$, $W_{5b}$ respectively of the resistance 33, the electrical power consumption $W_5$ is obtained from Expression 10 as expressed in Expression 18.

$$W_5 = \frac{1}{2}C\{5-40\}^2 + \frac{1}{2}C\{-40-5\}^2 = 1625C(W) \tag{18}$$

From Expression 18, it is understandable, as compared with the electrical power consumption in a case where the charging is made directly as expressed in Expression 17, that the electrical power consumption is reduced to approximately ½. In this case, a charge energy $W_{C5}$ collected to the capacitor 50 at charging/discharging +40V→+5V is obtained as a value as expressed in the following Expression 19, in which a difference in energy of the capacitor before and after charging/discharging is subtracted by the electric power consumption of the resistance 33.

$$W_{C5} = \left(\frac{1}{2}C \times 40^2 - \frac{1}{2}C \times 5^2\right) - \frac{1}{2}C \times (5-40)^2 = 175C(W) \tag{19}$$

The electric charge accumulated at the capacitor 50 in FIG. 3 can be reused as the charge energy $W_{C5}$ expressed in Expression 19.

Figure 4:
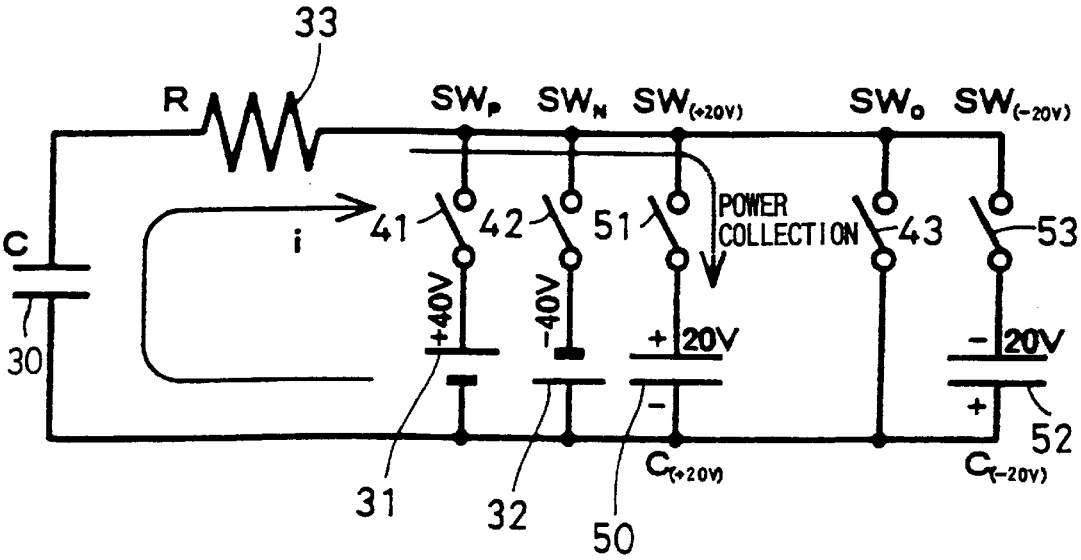
FIG. 4 is an equivalent circuit diagram relative to a method for driving according to further another embodiment of the invention.
Figure 5:
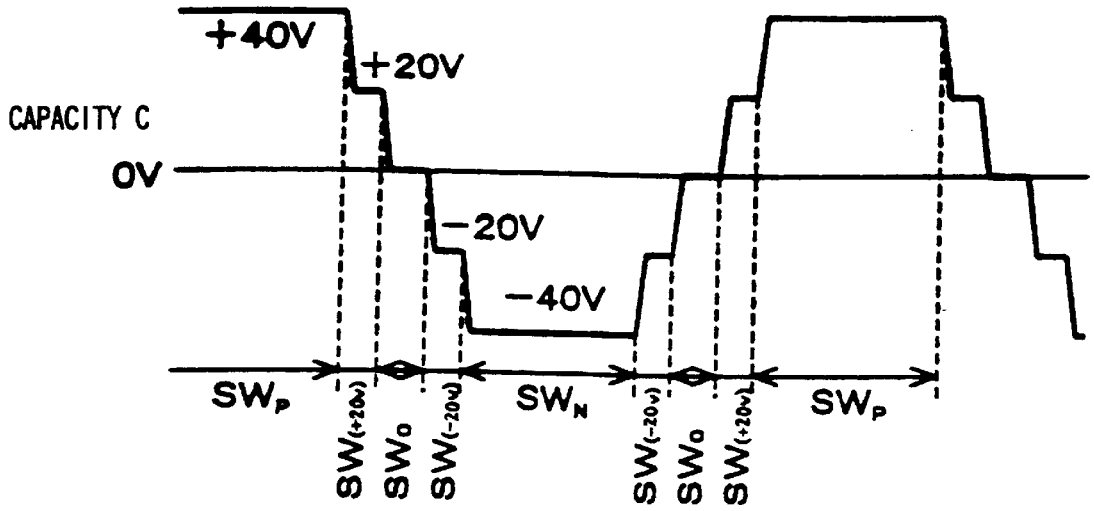
FIG. 5 is a time chart illustrating a voltage waveform applied to the capacitive display element 30 in a way of the method for driving shown in FIG. 4.

FIG. 4 illustrates a concept according to further another embodiment of the invention, in which the charging/discharging is made to an intermediate potential in a plurality of steps. In this embodiment, parts corresponding to the parts in FIG. 1 or FIG. 3 are given with identical reference numerals or characters and duplicated descriptions will be omitted. According to this embodiment, a capacitor 52 is added. The capacitor 52 is further connectable via a switch 53 represented with $SW_{(-20V)}$. According to the embodiment in FIG. 4, the charging/discharging is enabled to carry out in a plurality of steps as shown in FIG. 5. The electrical power consumption $W_6$, in a case where, as shown in FIG. 5, charging/discharging is made gradually from $V_M$=40V in several steps at intermediate potentials of $V_{s1}$=+20V, $V_{S2}$=0V, $V_{S3}$=−20V, is obtained from Expression 10 as expressed in the following Expression 20.

$$\begin{aligned} W_6 = &\frac{1}{2}C\{20-40\}^2 + \frac{1}{2}C\{0-20\}^2 + \frac{1}{2}C\{-20-0\}^2 + \\ &\frac{1}{2}C\{-40-(-20)\}^2 = 800C(W) \end{aligned} \tag{20}$$

The result of Expression 20 shows, as compared with the result of Expression 17, that the electric power consumption is reduced to ¼ thereof. In this case, the charge energy $W_{C20}$ that is collected at charging/discharging +40V→+20V to the capacitor 52 having a considerably larger capacity as compared with the capacity C of the capacitive display element 30 as a power supply of +20V is obtained by subtracting the electric power consumption by the resistance from a difference of the energy of the capacitor before and after charging/discharging and is expressed as Expression 21.

$$W_{C20} = \left(\frac{1}{2}C\times 40^2 - \frac{1}{2}C\times 20^2\right) - \frac{1}{2}C\times(20-40)^2 = 400C(W) \tag{21}$$

In comparison between the result of Expression 21 and that of Expression 20, it is understandable that ½ of the charge energy accumulated in the capacitor is reusable as an electric power. Further, in a general way, at a charging/discharging of $\alpha V_M \rightarrow \beta V_M$, assuming N is an integral number larger than 2, in case where the potential of the power supply to be charged/discharged is gradually modulated by a step of $(\beta-\alpha)V_M/N$, it is expressed as:

$$\alpha V_M \rightarrow \left\{\alpha + \frac{1}{N}(\beta-\alpha)\right\}V_M \rightarrow \left\{\alpha + \frac{2}{N}(\beta-\alpha)\right\}V_M \rightarrow \left\{\alpha + \frac{3}{N}(\beta-\alpha)\right\}V_M \rightarrow \ldots \rightarrow \left\{\alpha + \frac{N}{N}(\beta-\alpha)\right\}V_M \tag{22}$$

Assuming that the electric power consumption is $W_N$, the electrical power consumption $W_N$ at this time is obtained from Expression 10 as expressed in Expression 23.

$$\begin{aligned} W_N &= \frac{1}{2}C\left[\left\{\alpha + \frac{1}{N}(\beta-\alpha)\right\} - \alpha\right]^2 V_M^2 + \\ &\quad \frac{1}{2}C\left[\left\{\alpha + \frac{2}{N}(\beta-\alpha)\right\} - \left\{\alpha + \frac{1}{N}(\beta-\alpha)\right\}\right]^2 V_M^2 + \ldots + \\ &\quad \frac{1}{2}C\left[\left\{\alpha + \frac{N}{N}(\beta-\alpha)\right\} - \left\{\alpha + \frac{N-1}{N}(\beta-\alpha)\right\}\right]^2 V_M^2 \\ &= \frac{1}{2}C\left[\frac{1}{N}(\beta-\alpha)\right]^2 V_M^2 + \frac{1}{2}C\left[\frac{1}{N}(\beta-\alpha)\right]^2 V_M^2 + \ldots + \\ &\quad \frac{1}{2}C\left[\frac{1}{N}(\beta-\alpha)\right]^2 V_M^2 = \frac{1}{2}C\{(\beta-\alpha)V_M\}^2 \times \frac{1}{N} \end{aligned} \tag{23}$$

In comparison between Expression 23 and Expression 10, it is understandable that the electric power consumption is reduced to 1/N. In this case also, same as Expression 19 and Expression 21, the charge energy collected to power supplies of intermediate potential is reusable as electric power.

Figure 6:
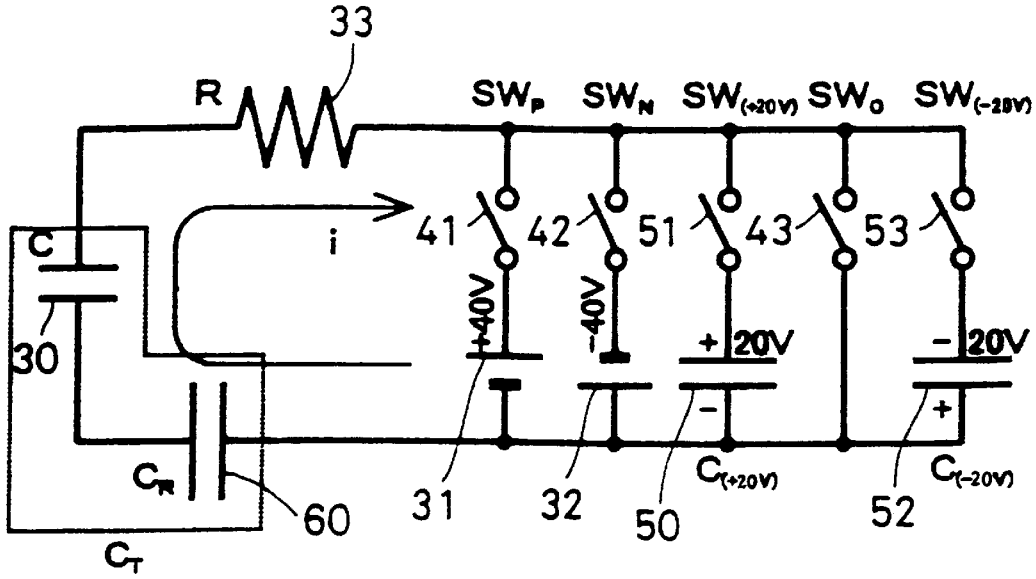
FIG. 6 is equivalent circuits diagram in a way of method for driving according to further another embodiment of the invention.
Figure 9:
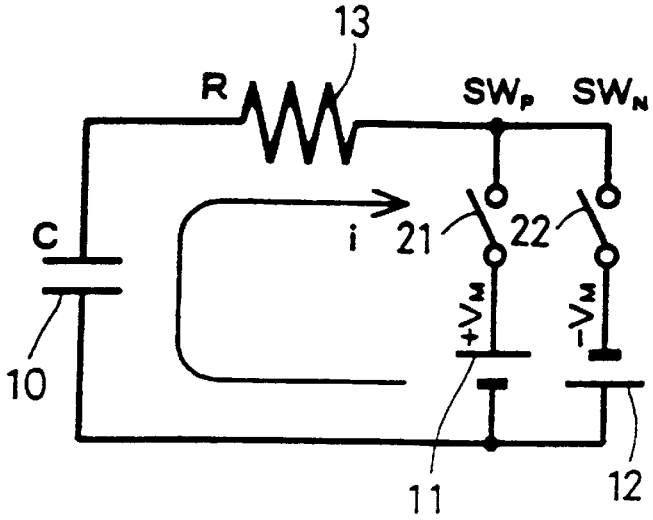
FIG.9 Prior Art
FIG. 9 is an equivalent circuit diagram of conventional driving method.
Figure 10:
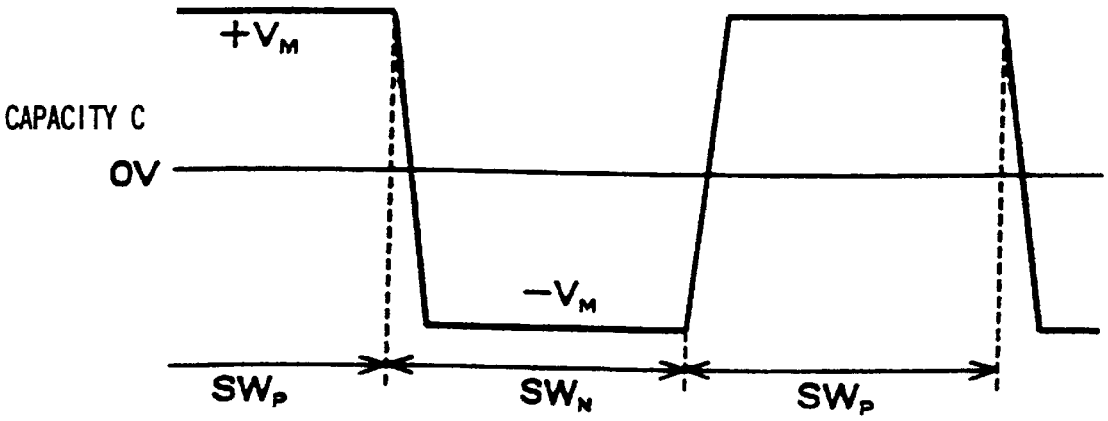
FIG.10 Prior Art
FIG. 10 is a time chart illustrating a voltage waveform applied to the capacitive display element 10 in a way of a driving method shown in FIG. 9.

FIG. 6 illustrates an equivalent circuit in connection with the driving method according to further another embodiment of the invention. In this embodiment, parts corresponding to the parts in the respective embodiments in FIG. 1, FIG. 3 and FIG. 4 are given with identical reference numerals or characters and duplicated descriptions will be omitted. According to this embodiment, the electric charge is not charged/discharged directly to the capacitive display element 30 from the power supply, but the charging/discharging is made via a capacitive coupling with a capacitor 60 having a capacity $C_R$ considerably larger as compared with the capacity C of the capacitive display element 30. Composite capacity $C_T$ of the capacity C of the capacitive display element 30 and the capacity $C_R$ of the capacitor 60 is obtained as Expression 24.

$$C_r = \frac{1}{1/C + 1/C_R} = \frac{C}{1 + C/C_R} \tag{24}$$

Sine $C \ll C_R$, $C/C_R \approx 0$, Expression 24 results in as expressed in Expression 25.

$$C_r \approx C \tag{25}$$

That is to say, since the equivalent circuit shown in FIG. 6 is substantially same as the equivalent circuit shown in FIG. 4, the same reduction effect of the electric power consumption is obtained and the electric charge collected in the capacitor 60 is also reusable as the electrical power.

In the above-described embodiments, although a voltage of $+V_M \rightarrow -V_M$ ($\alpha=1$, $\beta=-1$) is used as an example of charging/discharging, it is thinkable the same in a case where a voltage of $-V_M \rightarrow +V_M$ ($\alpha=-1$, $\beta=1$) is used for charging/discharging. Further, even when the identical technique is applied to a drive circuit at the scan-side, it has been verified from experimental facts that the same reduction effect of the electrical power consumption is obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for driving a capacitive display apparatus having a plurality of display pixels comprised of capacitive elements which are disposed respectively at crossing portions between data-side electrodes and scan-side electrodes, the method comprising:

driving the data-side electrodes at a voltage corresponding to display data, while scanning the scan-side electrodes to be selected sequentially;

applying a driving voltage to the display pixels to carry out a display operation;

when the a data-side electrode is driven to be charged with a voltage having an inverse polarity relative to a voltage charged at a previous charge in a pixel, charging/discharging the data-side electrode to an intermediate potential level of an absolute value smaller than the voltage applied for display operation between the charging voltages before and after driving the same, and wherein said charging/discharging of the data-side electrode to the intermediate potential is performed using at least one switch that short-circuits the data-side electrode and scan-side electrode of the capacitive element of the pixel, wherein said at least one switch is located in parallel with each of a positive power supply and a negative power supply for causing the capacitive element to be negatively and positively charged, respectively.

2. The method for driving the capacitive display apparatus of claim 1, wherein when the scan-side electrodes are driven so as to be charged at a voltage with an inverse polarity relative to the voltage charged at the previous charge, the scan-side electrodes are charged/discharged once to an intermediate potential level between the charging voltages before and after driving the scan-side electrodes.

3. The method for driving the capacitive display apparatus of claim 1, wherein the intermediate potential is the ground potential.

4. The method for driving the capacitive display apparatus of claim 1, wherein the charging/discharging to a intermediate potential is carried out in such manner that the power supply potential to be charged/discharged is gradually modulated in three or more steps within a range of the charging voltages before and after driving the scan-side electrodes.

5. The method for driving the capacitive display apparatus of claim 1, wherein the capacitive display element is an inorganic EL element.

6. The method for driving the capacitive display apparatus of claim 1, wherein the capacitive display element is a liquid crystal display element.

7. A method for driving a capacitive display apparatus having a plurality of display pixels comprising capacitive elements which are disposed respectively at crossing portions between data-side electrodes and scan-side electrodes, the method comprising:

driving the data-side electrodes at voltage corresponding to display data, while scanning the scan-side electrodes to be selected sequentially;

applying driving voltage to the display pixels to carry out a display operation;

when the data-side electrodes are driven to be charged with voltage having an inverse polarity relative to voltage charged at a previous charge, charging/discharging the data-side electrodes once to an intermediate potential level having an absolute value smaller than the voltage applied for display operation between the charging voltages before and after driving the same; and wherein the charging/discharging to an intermediate potential is carried out using a capacitor of potential between the charging/discharging voltages before and after the driving the scan-side electrodes.

8. The method for driving the capacitive display apparatus of claim 7, wherein an electric charge collected to the capacitor of random potential is reused.

9. A method for driving a capacitive display apparatus having a plurality of display pixels comprising capacitive elements which are disposed respectively at crossing portions between data-side electrodes and scan-side electrodes, the method comprising:

driving the data-side electrodes at voltage corresponding to display data, while scanning the scan-side electrodes to be selected sequentially;

applying driving voltage to the display pixels to carry out a display operation;

when the data-side electrodes are driven to be charged with voltage having an inverse polarity relative to voltage charged at a previous charge, charging/discharging the data-side electrodes once to an intermediate potential level having an absolute value smaller than the voltage applied for display operation between the charging voltages before and after driving the same; and wherein the process of charging/discharging to the intermediate potential is carried out in such way that the charging/discharging to the capacitive display element is made, not by charging/discharging an electrical charge directly to the capacitive display element, but by charging/discharging an electrical potential of one electrode of the capacitor to change an electrical potential of another electrode.

* * * * *